US009147563B2

(12) United States Patent
Makarov

(10) Patent No.: US 9,147,563 B2
(45) Date of Patent: Sep. 29, 2015

(54) COLLISION CELL FOR TANDEM MASS SPECTROMETRY

(71) Applicant: Thermo Fisher Scientific (Bremen) GmbH, Bremen (DE)

(72) Inventor: Alexander Alekseevich Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/367,871

(22) PCT Filed: Dec. 20, 2012

(86) PCT No.: PCT/EP2012/076501
§ 371 (c)(1),
(2) Date: Jun. 20, 2014

(87) PCT Pub. No.: WO2013/092923
PCT Pub. Date: Jun. 27, 2013

(65) Prior Publication Data

US 2015/0021472 A1 Jan. 22, 2015

(30) Foreign Application Priority Data

Dec. 22, 2011 (GB) ..... 1122179.3

(51) Int. Cl.
*H01J 49/02* (2006.01)
*H01J 49/00* (2006.01)
(Continued)

(52) U.S. Cl.
CPC ..... *H01J 49/0081* (2013.01); *H01J 49/009* (2013.01); *H01J 49/0031* (2013.01); *H01J 49/0045* (2013.01); *H01J 49/10* (2013.01); *H01J 49/40* (2013.01)

(58) Field of Classification Search
USPC ..... 250/281, 282, 285, 286, 287, 288
See application file for complete search history.

(56) References Cited

U.S. PATENT DOCUMENTS 5,572,035 A 11/1996 Franzen
5,783,824 A 7/1998 Baba et al.
(Continued)

FOREIGN PATENT DOCUMENTS

EP 1505632 A1 2/2005
EP 1505635 A2 2/2005
(Continued)

OTHER PUBLICATIONS

Bollen, G., ""Ion surfing" with radiofrequency carpets," International Journal of Mass Spectrometry 299 (2011), pp. 131-138.
(Continued)

*Primary Examiner* — Nicole Ippolito
*Assistant Examiner* — Hanway Chang
(74) *Attorney, Agent, or Firm* — Charles B. Katz

(57) ABSTRACT

A method and apparatus for tandem mass spectrometry is disclosed. Precursor ions are fragmented and the fragments are accumulated in parallel, by converting an incoming stream of ions from an ion source (10) into a time separated sequence of multiple precursor ions which are then assigned to their own particular channel of a multi compartment collision cell (40). In this manner, precursor ion species, being allocated to their own dedicated fragmentation cell chambers (41, 42 . . . 43) within the fragmentation cell (40), can then be captured and fragmented by that dedicated fragmentation chamber at optimum energy and/or fragmentation conditions.

31 Claims, 5 Drawing Sheets

(51) Int. Cl.
*H01J 49/10* (2006.01)
*H01J 49/40* (2006.01)

(56) References Cited

U.S. PATENT DOCUMENTS

| | | | |
|---|---|---|---|
| 5,847,386 | A | 12/1998 | Thomson et al. |
| 6,177,668 | B1 | 1/2001 | Hager |
| 6,300,626 | B1 | 10/2001 | Brock et al. |
| 6,483,109 | B1 | 11/2002 | Reinhold et al. |
| 6,498,342 | B1 | 12/2002 | Clemmer |
| 6,713,757 | B2 | 3/2004 | Tanner et al. |
| 6,794,642 | B2 | 9/2004 | Bateman et al. |
| 6,875,980 | B2 | 4/2005 | Bateman et al. |
| 6,987,264 | B1 | 1/2006 | Whitehouse et al. |
| 7,019,289 | B2 | 3/2006 | Wang |
| 7,034,292 | B1 | 4/2006 | Whitehouse et al. |
| 7,049,584 | B1 | 5/2006 | Whitehouse et al. |
| 7,067,802 | B1 | 6/2006 | Kovtoun |
| 7,071,464 | B2 | 7/2006 | Reinhold |
| 7,157,698 | B2 | 1/2007 | Makarov et al. |
| 7,385,187 | B2 | 6/2008 | Verentchikov et al. |
| 7,514,673 | B2 | 4/2009 | Senko et al. |
| 7,560,688 | B2 | 7/2009 | Clowers et al. |
| 7,582,864 | B2 | 9/2009 | Verentchikov |
| 7,718,959 | B2 | 5/2010 | Franzen et al. |
| 7,781,728 | B2 | 8/2010 | Senko et al. |
| 7,858,926 | B1 | 12/2010 | Whitehouse et al. |
| 7,923,681 | B2 | 4/2011 | Collings et al. |
| 8,101,910 | B2 | 1/2012 | Loboda |
| 8,278,619 | B2 | 10/2012 | Makarov et al. |
| 8,334,507 | B1 | 12/2012 | Whitehouse et al. |
| 2004/0183007 | A1 | 9/2004 | Belov et al. |
| 2008/0048109 | A1 | 2/2008 | Schwartz et al. |
| 2008/0067349 | A1 | 3/2008 | Moskovets et al. |
| 2008/0087814 | A1 | 4/2008 | Loucks |
| 2008/0173807 | A1 | 7/2008 | Yoon et al. |
| 2008/0224033 | A1 | 9/2008 | Makarov |
| 2009/0206248 | A1 | 8/2009 | Makarov et al. |
| 2009/0294644 | A1 | 12/2009 | Belov |
| 2011/0240851 | A1 | 10/2011 | Okumura et al. |
| 2011/0266426 | A1 | 11/2011 | Schwartz et al. |
| 2012/0032074 | A1* | 2/2012 | Kenny ..... 250/283 |

FOREIGN PATENT DOCUMENTS

| | | | |
|---|---|---|---|
| GB | 2441198 | A | 2/2008 |
| WO | WO9214259 | A1 | 8/1992 |
| WO | WO2010120496 | A1 | 10/2010 |
| WO | WO2012141878 | A2 | 10/2012 |

OTHER PUBLICATIONS

Schwarz, S., "RF ion carpets: the electric field, the effective potential, operational parameters and an analysis of stability," International Journal of Mass Spectrometry 299 (2011), pp. 71-77.

* cited by examiner

COLLISION CELL FOR TANDEM MASS SPECTROMETRY

FIELD OF THE INVENTION

This invention relates to a collision cell for a tandem mass spectrometer, to a tandem mass spectrometer including a collision cell, and to a method of tandem mass spectrometry.

BACKGROUND OF THE INVENTION

Tandem mass spectrometry (MS/MS) is an established technique for improving the throughput of mass analysis in a mass spectrometer. Traditionally, one precursor is selected at a time, subjected to fragmentation and then its fragment analysed in the same or a subsequent mass analyser. When analysing complex mixtures (such as are typical for proteomics, environmental and food analysis), so many precursors must be analysed in a limited time period that there is insufficient time to achieve a good signal-to-noise ratio for each of the precursors. In consequence, tandem mass spectrometry techniques have been developed. Here, an incident ion beam is split into packets in accordance with their mass to charge ratio (m/z) and one packet is then fragmented without the loss of another packet, or in parallel with another packet.

The splitting of the ion beam into packets can be performed with a scanning device that stores ions of a broad mass range (such as a 3D ion trap: see for example WO-A-03/03010, or a linear trap with radial injection as for example in U.S. Pat. No. 7,157,698). Alternatively, ion beam splitting can be achieved through the use of a pulsed ion mobility spectrometer (eg as is disclosed in WO-A-00/70335 or U.S. Pat. No. 6,906,319), through a linear time-of-flight mass spectrometer as is shown in U.S. Pat. No. 5,206,508, or using multi-reflecting time-of-flight mass spectrometer (see, for example, WO-A-2004/008481). As yet another alternative, ion beam splitting can be achieved along a spatial coordinate as is disclosed for example in U.S. Pat. No. 7,041,968 and U.S. Pat. No. 7,947,950.

In each case, this first stage of mass analysis is followed by fast fragmentation, typically in a collision cell (preferably having an axial gradient) or by a pulsed laser. The resulting fragments are analysed (preferably by employing another TOF) on a much faster time scale than the scanning duration (so called "nested times").

This approach provides throughput without compromising sensitivity. In a more traditional multi-channel MS/MS technique, by contrast, a number of parallel mass analysers (typically ion traps) are used to select one precursor each. The resultant fragments are then scanned out to an individual detector (e.g. the ion trap array shown in U.S. Pat. No. 5,206,506, or the multiple traps of U.S. Pat. No. 6,762,406). Other alternative arrangements, such as are shown in U.S. Pat. No. 6,586,727, U.S. Pat. No. 6,982,414, or U.S. Pat. No. 7,759,638, acquire all fragments from all precursors simultaneously, in one spectrum, which is then subsequently deconvoluted. However such traditional methods inherently lack dynamic range, and face challenges with reliability of identification.

The very limited time which is allocated for each fragment scan (typically, 10-20 microseconds) in the "nested times" approach of the above methods presents particular challenges. In particular, the "nested times" approach, involving the splitting of ion packets in time or space, inherently cannot provide high-performance analysis of obtained fragments. Increasing the scan time would further jeopardise the analytical performance of the precursor isolation, the latter already being quite poor when compared with routine present-day MS/MS. In addition, the "nested times" approach is incompatible with increasingly popular "slow" methods of fragmentation such as electron-transfer dissociation (ETD) which require up to a few tens of milliseconds for fragmentation to take place. Finally, the low transmission of the last-stage orthogonal-acceleration TOF offsets any advantages obtained by removal of losses in the precursor selection.

SUMMARY OF THE INVENTION

The present invention seeks to address these problems with the prior art.

According to a first aspect of the present invention, there is provided a method of tandem mass spectrometry as set out in claim 1.

The present invention thus, in a first aspect, provides for fragmentation of precursor ions and accumulation of the fragments in parallel, by converting an incoming stream of ions from an ion source into a time-separated sequence of multiple precursor ions, which are then assigned to their own particular channel of a multi compartment collision cell. In this manner, precursor ion species, being allocated to their own dedicated fragmentation cell chambers within the fragmentation cell, can then be captured and fragmented by that dedicated fragmentation chamber at optimum energy and/or fragmentation conditions.

It is to be understood that the invention is equally applicable to both individual ion species (each being allocated separately to its own chosen fragmentation cell chamber), to a continuous range of masses forming a subset of the broader mass range from the ion source, and even to a selection of multiple ion species from the ion source which are not adjacent to each other in the precursor mass spectrum of the ions from the ion source. Any combination of these (i.e. a single ion species in one of the, or some of the, chambers, a continuous mass range of precursors in one of the, or some others of the, chambers, and/or a further non-continuous plurality of precursor ion species derived from the ion source) is also contemplated. Thus $M_i$ and $M_j$ are not to be construed narrowly in the sense of a single ion species but as a single ion species of a single m/z and/or a range of precursor ion species of different m/z.

The separation in time between adjacent precursors or precursor ranges is shorter than the time of analysis of fragments subsequently in the mass analyser. Thus, high resolution analysis of fragments is possible.

In order to maximise the duty cycle, ions of different precursor masses or mass ranges are preferably fragmented and stored in respective ones of the spatially separated fragmentation cell chambers, at partially overlapping times. In other words, at least two of the fragmentation cell chambers will contain precursor and/or fragment ions simultaneously, during part of the process in a first preferred embodiment. The method in one particular embodiment includes techniques for sequential emptying of the fragmentation cell by emptying an output cell chamber, then sequentially shifting the contents of the remaining chambers to a next respective cell chamber before repeating the process so as to eject ions sequentially from the output chamber in a "conveyor-type" or "shifting-type" arrangement. In an alternative embodiment, however, ions are ejected from each of the fragmentation cell chambers separately and by direct communication of each fragmentation cell chamber with the mass analyser. In other words, the different precursor ion species and their fragments in the different fragmentation cell chambers each communicate directly with a mass analyser and do not pass through other chambers between the step of ion ejection from each chamber and the mass analysis stage.

The precursor ions separated in time preferably arrive at a downstream ion deflector for directing the ions to respective fragmentation cell chambers. The process preferably further comprises applying a pulsed voltage to the ion deflector to direct the ions to respective chambers.

In preference, the energy of the precursor ions may be adjusted prior to entry into the fragmentation cell chambers. Furthermore, optionally, differential pumping of a channel between the ion deflector and fragmentation cell may take place.

Various "traditional" and also "slow" fragmentation techniques may be employed, together or separately, within the fragmentation cell—that is, the same or different fragmentation techniques may be applied to different fragmentation cell chambers within the same fragmentation cell. Techniques such as activated ion electron transfer dissociation (ETD), multi stage ETD, and so forth may be employed.

In accordance with a second aspect of the present invention, there is provided an arrangement for a tandem mass spectrometer as defined in claim 13.

The invention also extends to a tandem mass spectrometer comprising an ion source, a first stage of mass analysis, a multi-compartmental fragmentation cell and an ion deflector to populate the chambers of the fragmentation cell with precursor ions of different mass to charge ratios, together with a second stage of mass analysis downstream of that. The tandem mass spectrometer according to the present invention is defined in claim 23.

The first stage of mass analysis might be an ion trap, such as a linear ion trap with radial or axial ejection, a time of flight mass analyser such as a multi-turn or multi-reflection TOF for example; an ion mobility spectrometer; or a magnetic sector analyser or other spatially dispersing analyser. The second mass analyser may, by contrast, be a high resolution mass analyser, for instance an orbital trapping analyser such as the Orbitrap™ mass analyser or a time of flight analyser such as a multi-turn or multi-reflection TOF analyser.

Embodiments of the present invention thus provide for a method and apparatus which permits sufficient time to fragment ions including more recent "slow" techniques such as electron transfer dissociation. The multi channel arrangement of the fragmentation cell allows sufficient time for high performance analysis of fragment ions.

Various other preferred features of the present invention will be apparent from the appended claims and from the following specific description of some preferred embodiments.

BRIEF DESCRIPTION OF THE DRAWINGS

The invention may be put into practice in a number of ways and some embodiments will now be described by way of example only and with reference to the accompanying figures in which.

DETAILED DESCRIPTION OF PREFERRED EMBODIMENTS

Figure 1:
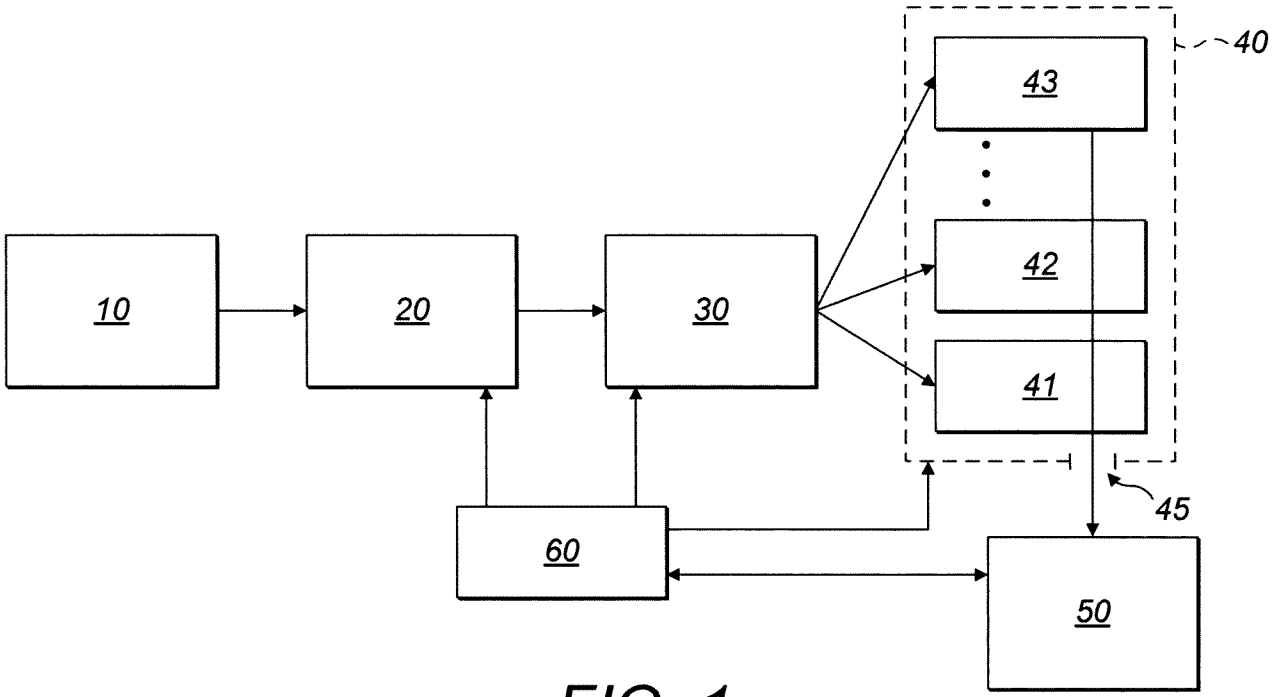
FIG. 1 shows a highly schematic arrangement of a first embodiment of a tandem mass spectrometer with a multi compartmental fragmentation cell in accordance with the present invention.

Referring first to FIG. 1, a highly schematic block diagram of the components for a tandem mass spectrometer embodying the present invention is shown. The embodiment of FIG. 1 may be referred to herein as being of a "conveyor-type". In the arrangement of FIG. 1, ions are introduced from an ion source 10 into a first stage of mass analysis 20. The ion source 10 may be continuous, quasi continuous (such as, for example, an electrospray ionisation source) or pulsed such as a MALDI source. In FIG. 1, ion optics and various other components necessary for transporting ions between various stages of the tandem mass spectrometer are not shown, for clarity, though these will in any event be familiar to the skilled person.

The first stage of mass analysis 20 may be one of an ion trap, such as a linear ion trap with radial or axial ejection, a time of flight (TOF) analyser of any known type, including but not limited to multi-turn and multi-reflection TOFs, an ion mobility spectrometer of any known type, or a spatially dispersing analyser such as a magnetic sector or distance-of-flight analyser.

The first stage of mass analysis 20 ejects precursor ions. Ions of different mass to charge ratios, m/z, emerge from the first stage of mass analysis at different moments in time, or separate in time of flight downstream of the first stage of mass analysis. In either case, precursor ions of different mass to charge ratios arrive at a rastering device 30 such as an ion deflector at different times. The rastering device 30 deflects precursor ions with mass to charge ratios $m_1, m_2 \ldots m_N$ into corresponding chambers 1, 2 . . . N of a fragmentation cell 40. Each mass to charge ratio $m_1, m_2 \ldots m_N$ represents a single ion species having a single mass to charge ratio, or alternatively a range of precursor ions having a commensurate range of mass to charge ratios. Techniques for parallel analysis of multiple mass ranges using the arrangement of FIG. 1 will be summarised below; a particularly preferred approach to the analysis of a relatively broad mass range of precursors by segmentation into a plurality of narrower precursor mass ranges, and targeted fragmentation of different segments in multiple scan cycles, is described in our co-pending application entitled "Method of Tandem mass spectrometry", filed at the UKIPO on the same day as the present application, and incorporated by reference in its entirety.

Each collision cell chamber 1, 2 . . . N is denoted as 41, 42 . . . 43 in FIG. 1. For specially dispersing analysers, the rastering device 30 is inherently integrated with the mass analyser 20 in a single unit.

Ions enter each fragmentation cell chamber and are fragmented there. The resulting fragments, and any remaining precursor ions, are stored within the respective chamber.

The particular, optimal fragmentation conditions (energy collision gas, collision technique, slow, such as ETD, or fast as collision-induced dissociation)—can be selected for each collision cell chamber in accordance with the anticipated precursor ion. The rastering device 30 is under the control of a controller 60 and may use information from calibration or ion optical modelling, or previous mass spectra, to control the distribution of the different ion species arriving at the rastering device 30.

Once ions have been stored in the fragmentation cell chambers sufficient for the required degree of fragmentation, ions are ejected from the fragmentation cell 40 to a second stage of mass analysis 50.

In the embodiment of FIG. 1, fragment ions and any remaining precursor ions from each of the fragmentation cell chambers are ejected sequentially to the mass analyser 50 via a single exit aperture 45 for the fragmentation cell 40. Specifically, fragment and any remaining precursor ions from the fragmentation cell chamber 41 which is closest to the mass analyser 50 are injected into that mass analyser for mass analysis. Chamber 41 may thus be termed the output chamber. There is then a short delay (preferably less than 1-5 ms), whilst fragment and any remaining precursor ions from the second closest fragmentation cell chamber 42 are shifted into the fragmentation cell chamber 41, which is closest to the mass analyser 50. This is achieved by applying displacing DC voltages to the electrodes of the second closest fragmentation cell chamber 42.

Similar displacing DC voltages are sequentially applied to each of the remaining fragmentation cell chambers, so that the ion populations shift by 1 fragmentation cell chamber at a time towards the mass analyser 50, once the previous population has been ejected from the fragmentation cell chamber closest to the mass analyser 50.

After the first shift of the different fragment ions from the fragmentation cell chambers 41, 42 . . . 43, the n-th fragmentation cell chamber 43, which is furthest from the mass analyser 50, is empty. Interleaving may then be carried out, whereby that n-th fragmentation cell chamber 43 is filled with either the same precursor species as was previously injected into that fragmentation cell chamber 43, or alternatively, a different precursor ion species. Thus, the embodiment of FIG. 1 preferably employs a one dimensional array of shifting cells. In other embodiments two dimensional arrays can be arranged.

Turning now to FIG. 2, the rastering device 30 and fragmentation cell 40 of FIG. 1 is shown in further detail. The rastering device 30 is preferably a pair of deflector plates with pulsed voltages applied to them. Optionally, the rastering device 30 may be complemented by an energy lift 31, which is pulsed in synchronisation (under the control of the controller 60) with the rastering device 30, and adjusts the ion energy of precursor ions so that each precursor ion species enters its respective fragmentation cell chamber at an energy optimum for the required degree of fragmentation. The energy lift 31 may be located before or after the rastering device 30. However, if the first stage of mass analysis 20 is a time of flight analyser, then it is desirable that both the rastering device 30 and the energy lift 31 are located close to the plane of TOF focusing.

Each of the fragmentation cell chambers 41 . . . 43 is preferably formed of an RF-only multipole filled with collision gas. The chambers function not only to fragment ions, but also to ensure collisional cooling of the fragments.

The ions are deflected to a particular fragmentation cell chamber and traverse a differentially pumped volume labelled generally at 35 in FIG. 2 before entering entrance deflectors 81 . . . 83 of the fragmentation cell. Each cell chamber 41 . . . 43 has its own entrance deflector in this embodiment. The entrance deflectors 81 . . . 83 align the ion trajectory of incident ions of a particular mass to charge ratio with the axis of the fragmentation cell chamber into which these ions will be injected, and ensures the maximum acceptance of the ion beam. Although not shown in FIG. 2, it will also be understood that deceleration optics might also be included, as the ion energy is advantageously reduced from typically 1-3 keV/charge, down to 5-150 eV/charge.

Upon entering the fragmentation cell chambers 41 . . . 43, ions experience multiple collisions with collision gas, and fragment. A decelerating voltage between the entrance deflector 81 . . . 83 and the entrance aperture 41*a* . . . 43*a* of each fragmentation cell chamber may provide for an optimum collision energy alternatively or in addition to the optional energy lift 31. If non-collisional fragmentation techniques are used, then ions should enter the cell chambers at energies below fragmentation level. To simplify deceleration of ions by allowing higher energies at the entry and still avoiding fragmentation, light collision gases such as helium or hydrogen could be used. Fragments and remaining precursor ions are reflected at the far end of each fragmentation cell chamber by an appropriate DC voltage, and those ions subsequently lose energy through collisions so that they concentrate near the axis of each fragmentation cell chamber.

Figure 2B:
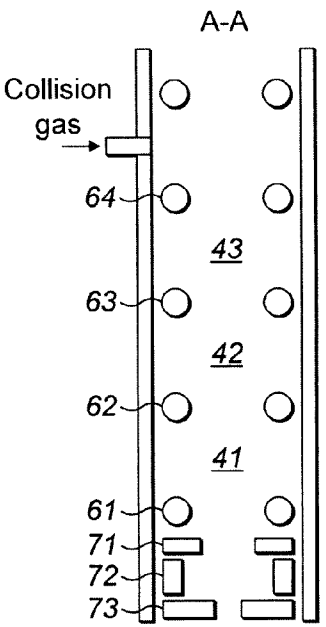
FIG. 2*a* and FIG. 2*b* show, respectively, front and side sectional views of the fragmentation cell arrangement of FIG. 1 in further detail.

Shifting of ions between the various fragmentation cell chambers 41 . . . 43 precedes as follows, with reference particularly to FIG. 2B. The multipole rods 61 and 62 define the first fragmentation cell chamber 41, the rods 62 also define the second fragmentation cell chamber 42, along with multipole rods 63. Rods 63 and 64 define the third fragmentation cell chamber 43, and so forth.

The DC offset on the rods 62, 63 . . . is raised relative to the DC offset on the rods 61. Suitably, the potential difference is 20-30 volts. The offset on the rods 61 is, in its turn, raised relative to a DC offset on electrodes 71, such as 5 volts. The electrodes 71 form a part of a curved linear trap, to be described below, which acts to permit orthogonal ejection of ions from the fragmentation cell 40.

Figure 2A:
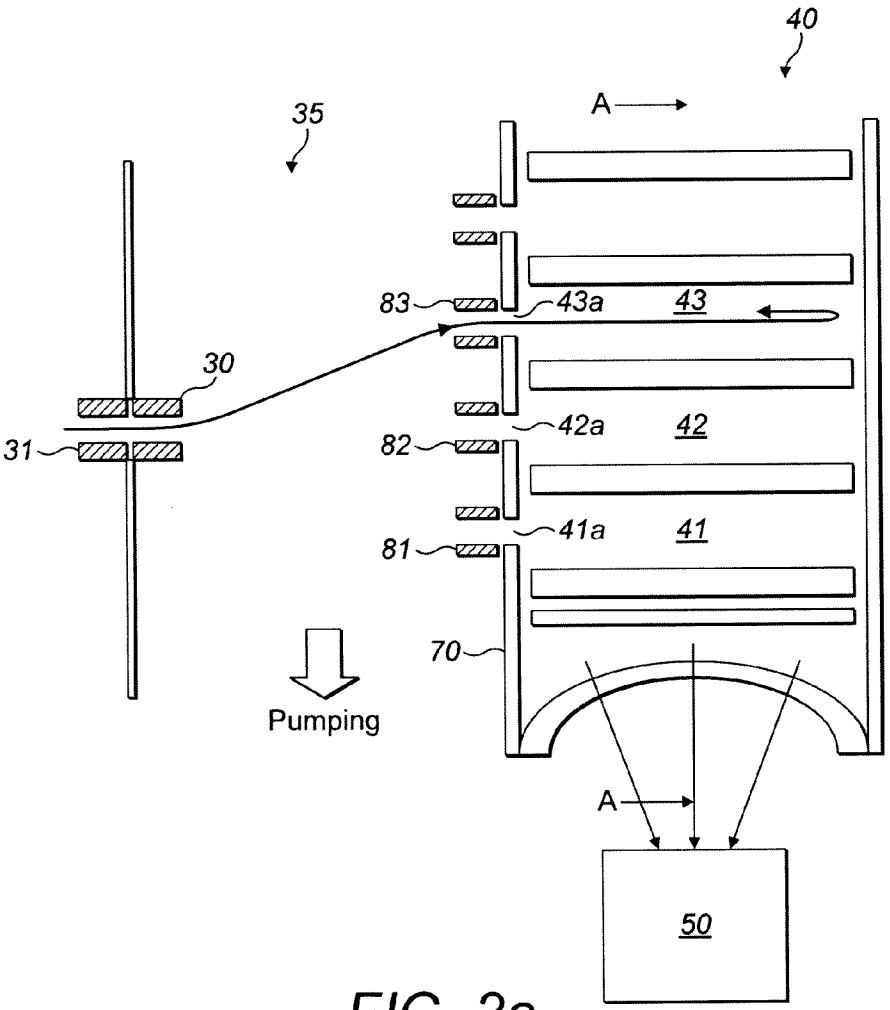

Each of the electrodes 61, 62, 63 . . . and 71 have RF voltages applied to them during the process of trapping and transfer. As a result, ions in the fragmentation cell chamber 41 are forced to move between electrodes 61 and 71 and into a curved linear trap 70 which is best seen in FIG. 2A. Such a curved linear trap, also termed a C-trap, is described for example in WO 2008/081334. Once ions from the fragmentation cell chamber 41 have entered the curved linear trap 70, they are stored along a curved axis and pulsed out into the mass analyser 50. The process is described in WO-A-05/124,821. After that, the DC offset on the rods 61 is raised, for example, to 10 volts, and the DC offset on the rods 62 is lowered, for example, to ground potential. The DC offset on the rods 63 . . . is kept high (for example, 20-30 volts), so that ions from the fragmentation cell chamber 42 are then forced into the fragmentation cell chamber 41 by the resulting transverse electric field created by the potential difference. This sequence is repeated across the entire parallel array of ion traps constituted by the N fragmentation cell chambers 41 . . . 43. In other words, the DC offset on the rods 62 is raised whilst the offset on rod 63 is lowered, resulting in a transfer of content of the fragmentation cell chamber 43 into the fragmentation cell chamber 42, and so forth. Whilst ions are transferred from one fragmentation cell chamber to another, the fragmentation cell chamber itself is preferably not filled by the corresponding precursor ion species.

The mass analyser 50 may, in preference, be of the orbital trapping or time of flight type. For example, the Orbitrap mass analyser, or a multi-turn or multi-reflection time of flight mass analyser might be employed. Furthermore, each of the fragmentation cell chambers might be employed to store fragments from several precursors (preferably from considerably different mass to charge ratios), to increase throughput ("multiplexing"). Also, the transfer of ions from one fragmentation cell chamber to another might be accompanied by crude mass selection, as a consequence of the applied DC fields, and also further fragmentation, to yield further generation of fragments ($MS^N$, N=3, 4 . . . ). This also allows activated-ion ETD and multi-stage ETD to be accomplished.

Figure 3:
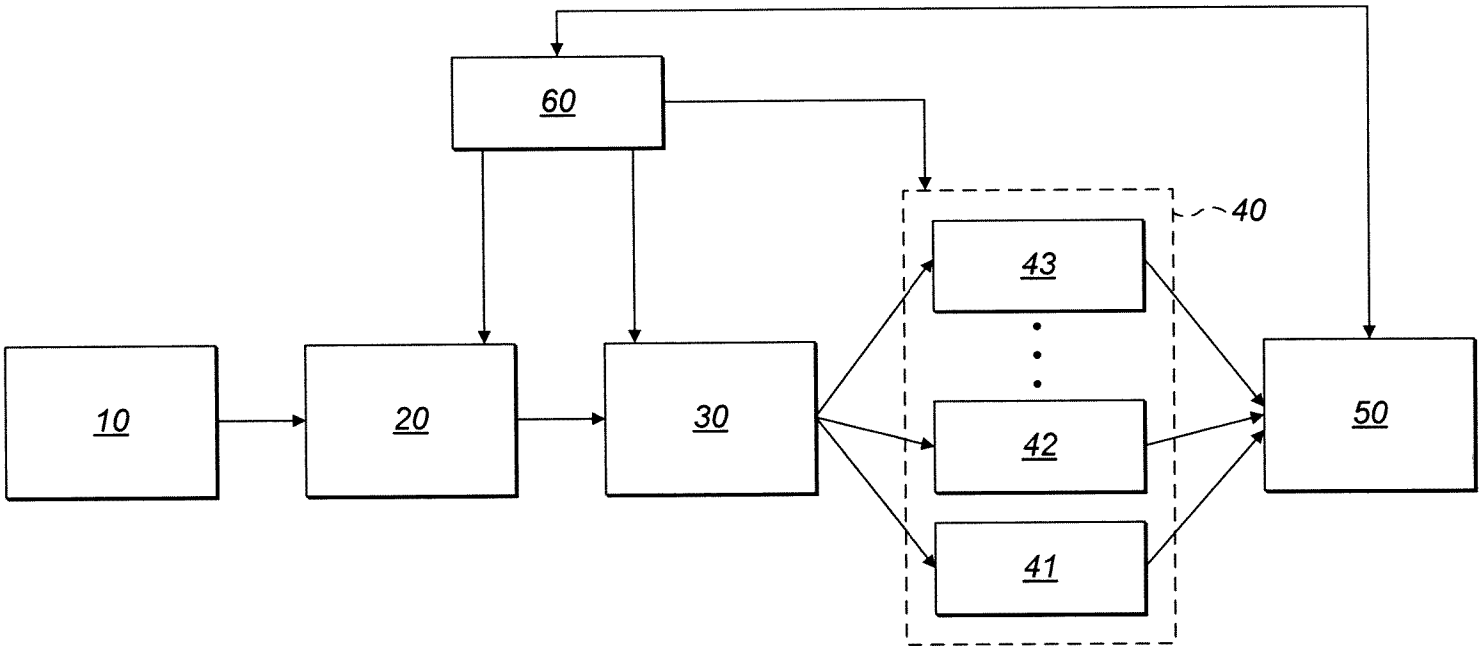
FIG. 3 shows a highly schematic layout of a tandem mass spectrometer in accordance with a second embodiment of the present invention, again with a multi compartmental fragmentation cell.
Figure 4:
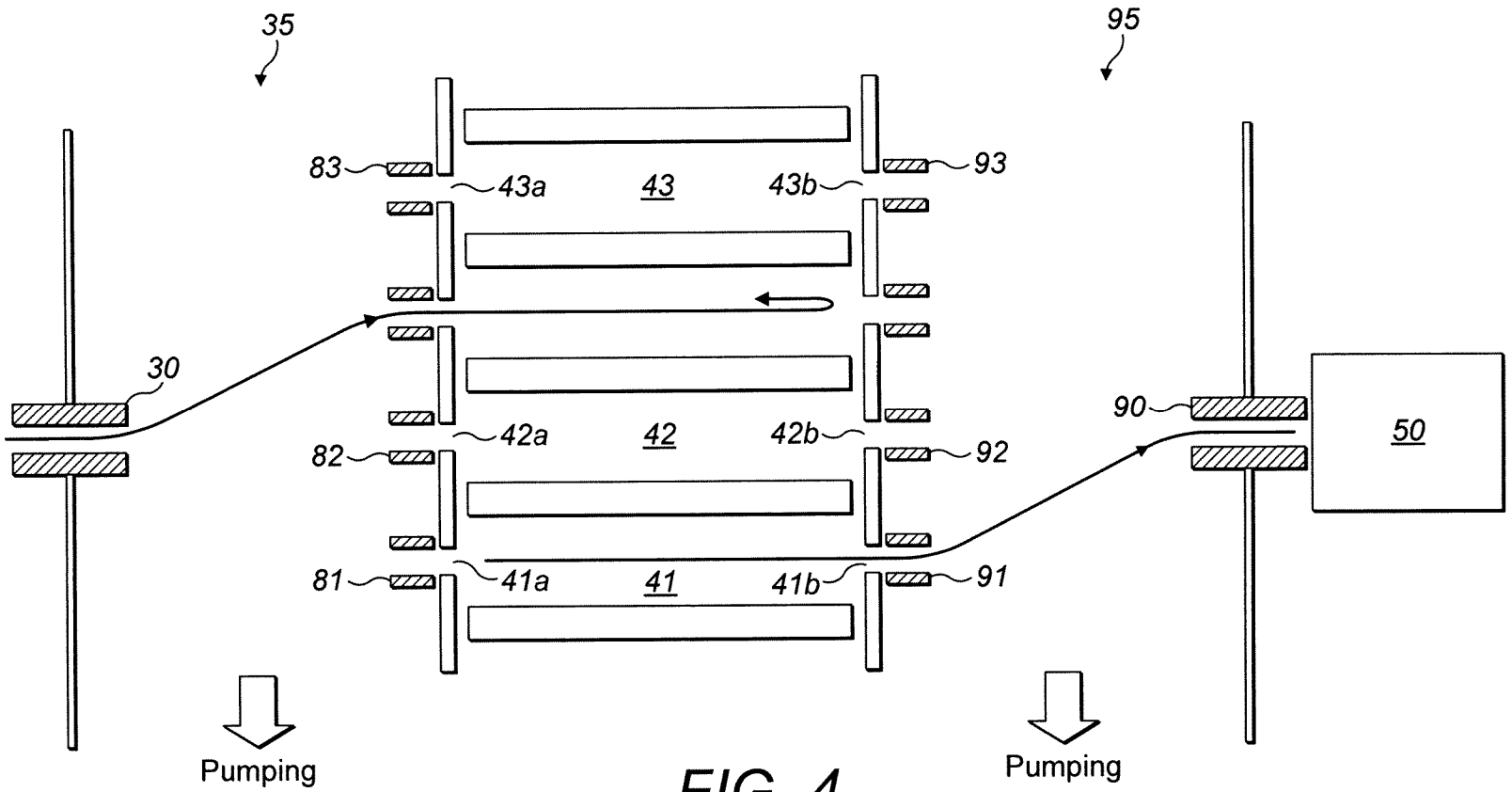
FIG. 4 shows a side sectional view of the multi compartmental fragmentation cell of FIG. 3 in further detail.

FIG. 3 shows an alternative embodiment of a tandem mass spectrometer with a fragmentation cell having parallel fragmentation cell chambers. As with FIG. 1, FIG. 3 shows the spectrometer in highly schematic block form for simpler explanation of the operation of it. FIG. 4 shows the novel fragmentation cell arrangement of FIG. 3 in more detail.

In FIG. 3, as may be seen, the tandem mass spectrometer comprises an ion source 10 of pulsed, quasi continuous or continuous type, such as an electrospray or MALDI ion source, in a similar manner to that of the FIG. 1 embodiment. Ions from the ion source enter the first stage of mass analysis 20 which, again, may be an ion trap, such as, preferably a linear ion trap with radial or axial ejection, a time of flight analyser of any known type, including a multi-turn and/or multi-reflection TOF device, an ion mobility spectrometer of any known type, or a spatially dispersing analyser, such as a magnetic sector analyser.

Ions within the first mass analyser are ejected so that they arrive at a rastering device 30 such that ions of different mass to charge ratio arrive at different times.

A system controller 60 controls the rastering device 30 to direct incident ions to a chosen one of multiple fragmentation cell chambers 41, 42 . . . 43 within in a fragmentation cell 40. The fragmentation cell chambers 41, 42 . . . 43 are arranged in parallel as can be seen in FIGS. 3 and 4. Thus, for example, ions with a first mass to charge ratio $m_1$ may be directed by the rastering device 30, under the control of the controller 60, to a first of the fragmentation cell chambers 41. Ions of a second mass to charge ratio $m_2$, arriving at the rastering device 30 at different time to the ions of mass to charge ratio $m_1$, may be directed to the second fragmentation cell chamber 42, and so forth. It will of course be understood that the order of arrival of precursor ions at the rastering device 30 need not be related to the physical order of the fragmentation cell chambers. Whilst it may be, in practical terms, easiest to scan incident ions arriving at the rastering device 30 in sequence, into successive adjacent ones of the fragmentation cell chambers, in other words, this is by no means essential as with the arrangement of FIG. 1 and FIG. 2, either calibration or ion optical modelling or previous mass spectra may be employed to allow the controller 60 suitably to control the rastering device 30 to direct appropriate precursor ions into appropriate fragmentation cell chambers.

Once ions have been injected by the rastering device 30 into a particular fragmentation cell chamber 41, 42 . . . 43, appropriate fragmentation conditions can be applied data dependently (that is, for example, as a result of pre scans, calibration and so forth), so that fragmentation of ions in a particular fragmentation cell chamber takes place under conditions that are optimised for the particular precursor ion species. For example, the collision energy for the particular ion species may be tuned to that ion species under the control of the controller 60. Energy lift means as described above in respect of FIG. 1 may optionally be employed in the FIG. 3 embodiment as well.

Unlike the arrangement of FIGS. 1 and 2, however, the output of each fragmentation cell chamber 41, 42 . . . 43, is in direct communication with an output exit of the fragmentation cell 40. By this means, ions in any one of the fragmentation cell chambers can be ejected, independently of the others and without the need to pass ions through any other fragmentation cell chambers, via the fragmentation cell ion exit, to a second stage mass analyser 50. The second stage (external) mass analyser 50 may, as with the arrangement of FIGS. 1 and 2, be a high resolution mass analyser such as an orbital electrostatic trap, a time of flight mass spectrometer and so forth. The second stage mass analyser 50 collects and detects the fragment ions and any remaining precursor ions which are ejected to it from the individual fragmentation cell chambers within the fragmentation cell 40. The results of the detection of the ejected ions by the second stage mass analysis 50 can be sent to the controller 60 for post processing or onward transmission to a pc (not shown in FIG. 3).

The arrangement of FIG. 3, in contrast to the arrangement of FIG. 1, allows for direct and independent transfer of ions from each fragmentation cell chamber to the second stage of mass analysis 50, without first passing through other fragmentation cell chambers. This allows greater freedom of operation and a larger variation in fill times for precursors of different intensities.

Turning now more particularly to FIG. 4, a part of the tandem mass spectrometer FIG. 3 is shown, between the rastering device 30 and the second stage mass analysis 50, in further detail. Ions are scanned by the rastering device 30 into a chosen one of the fragmentation cell chambers 41, 42 . . . 43 through respective input deflectors 81, 82 . . . 83 adjacent input apertures 41*a*, 42*a* . . . 43*a*. The volume between the rastering device 30 and the multiple input deflectors 81, 82 . . . 83 is differentially pumped and this is shown generally at reference numeral 35.

In the arrangement of FIGS. 3 and 4, ions exit each fragmentation cell chamber in the reverse sequence to their entry. This procedure may be seen best with reference to FIG. 4. Ions are firstly released by dropping the voltage on the exit aperture 41*b*, 42*b* . . . 43*b* on a particular fragmentation cell chamber 41, 42 . . . 43. After that, the ions are accelerated by applying a voltage between the exit aperture of a particular fragmentation cell chamber 41, 42 . . . 43 and its exit deflector 91, 92 . . . 93. Ions leave the exit deflector of a particular fragmentation cell chamber where they pass across a second differentially pumped volume 95 (FIG. 4) as they are directed by the exit deflector to arrive at an exit deflector 90 arranged within or adjacent to the exit aperture of the fragmentation cell 40.

Figure 5:
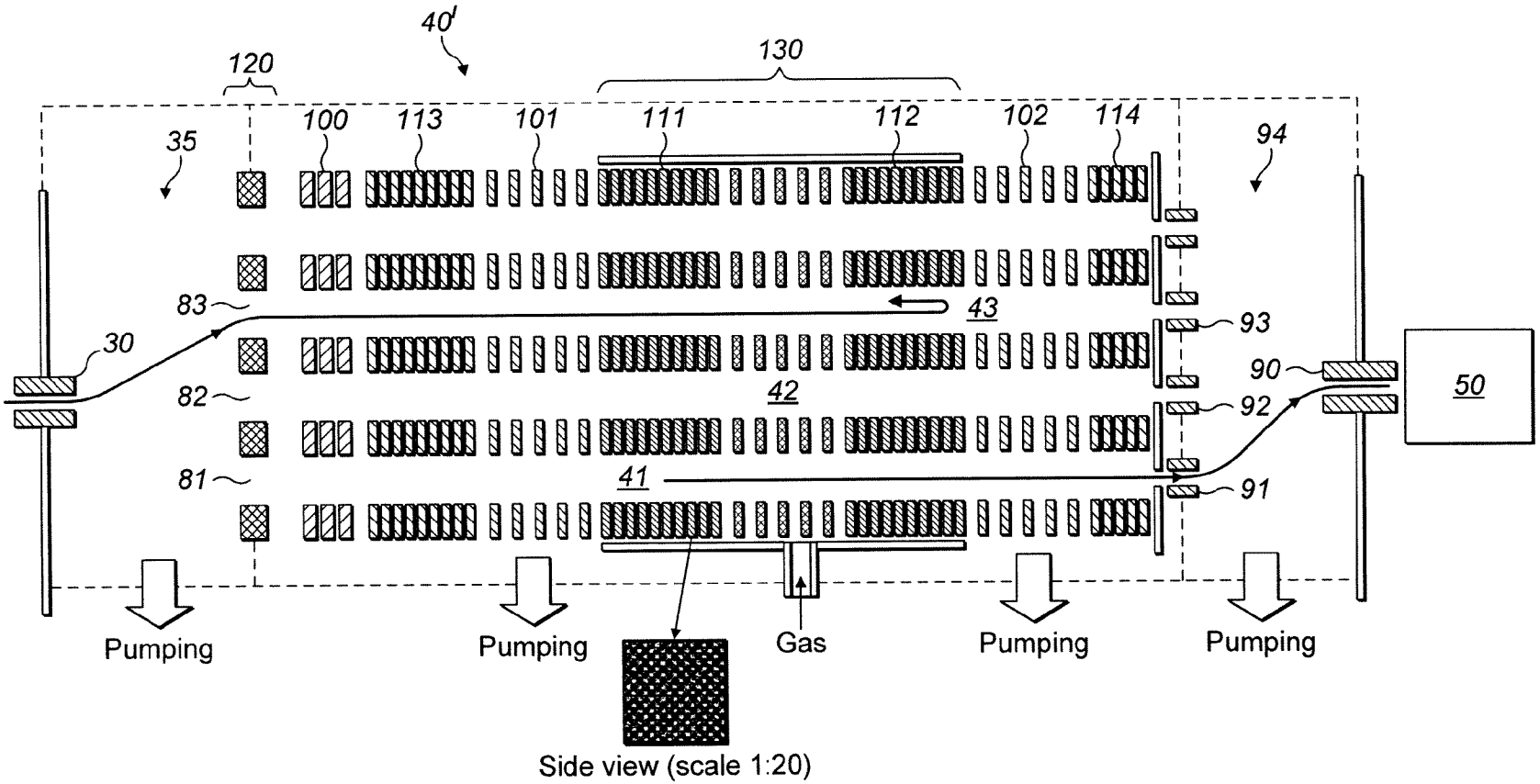
FIG. 5 shows a particular preferred arrangement of multi compartmental fragmentation cell suitable for use with the arrangement of FIG. 3.

FIG. 5 shows a preferred embodiment of a fragmentation cell arrangement, in cross-sectional view. The fragmentation cell arrangement of FIG. 5 includes the rastering device 30 of FIGS. 1 to 4, a differentially pumped volume 35 between the rastering device 30 and the fragmentation cell 40' indicated by the broken line, various stages of differential pumping to be further described below, an exit aperture deflector 90 and a second stage of mass analysis 50. The embodiment of FIG. 5 addresses several issues, firstly to reduce complexity of construction taking into account the difference in ion energies, the multiplicity of channels, and so forth, secondly to reduce ion losses when decelerating the precursor ions to low energies prior to injection into the individual fragmentation cell chambers and thirdly to provide a suitable arrangement for differential pumping of the cell.

In further detail, still referring to FIG. 5, precursor ions arrive at the rastering device 30 and are deflected by that towards one or other of the multiple fragmentation cell chambers 41, 42 . . . 43. Each of these fragmentation cell chambers has entrance aperture deflectors 81, 82, 83 to adjust the direction of travel of the incident ions from the rastering device and guide them into the respective fragmentation cell chamber. Each fragmentation cell chamber itself is of integrated construction. This integrated fragmentation cell chamber construction addresses the first of the above noted issues, namely how to construct the fragmentation cell chambers so as to address the differences in ion energies, the multiplicity of channels and so forth. As may be seen In FIG. 5, each fragmentation cell chamber is comprised of RF electrodes implemented as parts of a plate having multiple apertures. In other words, the multiple fragmentation cell chambers are formed from horizontally stacked plates with multiple apertures, each horizontally stacked plate having an aperture which aligns with the others to form the longitudinal axes of the various fragmentation cell chambers. The deflectors at the entrance apertures, 81, 82, 83 and also the end electrodes, are provided with different DC voltages for the different channels (fragmentation cell chambers) and these are implemented as printed circuit boards (PCBs) with individual conductors provided to each of the channels. The parts of the fragmentation cell arrangement of FIG. 5 constituting the entrance deflectors and end electrodes are labelled 120 and 130 respectively To address the problem of losses during deceleration of precursor ions to low energies, an Einzel lens 100 is integrated into each of the fragmentation cell chambers. A suitable lens is described, for example, for O'Connor et al, J. Am. Soc. Mass Spectrom.; 1991, 2, pages 322-335.

The problems of differential pumping of the fragmentation cell can be addressed by the creation of elongated areas of pressure gradient having aspect ratios of channel length to inscribed diameter in excess of about 10-50. In the case the cell consists of a sequence of N apertures with gaps between them, the aspect ratio (AR) is around N.

For example, for a system of 50 fragmentation cell chambers, each having an inner diameter (ID) of 4 mm, the pressure could be reduced from $P_c=3\times10^{-3}$ mbar in the nitrogen filled fragmentation cell 40', to a pressure $P_p=6\times10^{-4}$ mbar in the volumes labelled 101 and 102 in FIG. 5, with AR=20 (the sections labelled 111 and 112 in FIG. 5) and a pumping speed in the volumes 101 and 102 of FIG. 5, of 40 liters per second in total. The pressure can then be reduced to $P_f=5\times10^{-5}$ mbar in the volumes labelled 35 and 94 in FIG. 5, with a further AR=20 (sections 113 and 114 of FIG. 5) at a pumping speed of 100 liters per second in total in these volumes, In addition to the conventional molecular flow, there is also jetting of ions over the direct line of sight from one pressure region to another, resulting in additional increase of pressure, to consider. However, for AR>10 and a pressure drop less than ten fold, this effect is negligible. However, regions 111 to 114 of FIG. 5 could also be implemented as curved rather than straight sections, so that the line of sight from the high pressure region is then blocked.

It is desirable that ions are already decelerated at the start of the pressure gradient described above, and it is also preferable that the DC gradient is applied along the entire length of the fragmentation cell. On the output side of it, ions are already collisionally cooled so that they concentrate upon the axis of the fragmentation cell chamber, and might pass through a much smaller hole (for example, a hole having a 2 mm inner diameter). This allows the length of the region 114 to be reduced.

It will be appreciated that various modifications to the foregoing preferred embodiments can be contemplated. For example, in the embodiment of FIG. 3, each of the fragmentation cell chambers might form an individual mass analyser, such as a linear ion trap with axial or radial ejection (preferable with rectilinear type). In this case, ions are ejected with the help of an additional resonant excitation, preferably applied perpendicularly to the plane of the drawings.

Furthermore, in each of the embodiments described above, during trapping in the fragmentation cell chambers, ions might be subjected to electron transfer dissociation (ETD), electron capture dissociation (ECD), electron ionisation dissociation (EID) or other ion-ion, ion-molecule, ion-photon (e.g. irradiation by laser) reactions, metastable-atom dissociation, and so forth. Anions for ETD could be introduced either from the other end of the fragmentation cell, or via the same first stage of mass analysis 20 and rastering device 30.

Moreover, it is to be understood that many different schemes for ion capture and fragmentation within the multiple parallel fragmentation cell chambers are envisaged. In one embodiment, for example, the controller 60 may control the rastering device 30 to direct precursor ions of only a single ion species/mass to charge ratio into a respective separate one of the multiple fragmentation cell chambers. Within each chamber, as discussed, each ion can be fragmented, or not, under conditions optimal for the particular ion species and charge state in the particular fragmentation cell chamber. In particular, whilst it may be that each (single) ion species in each fragmentation cell chamber 41 . . . 43 is fragmented (though optimally under different fragmentation conditions), in other embodiments, some but not all of the ion species in the fragmentation cell 40 are fragmented. Thus what is ejected from the chambers (either using the conveyor ejection scheme of FIGS. 1 and 2 or the individual ejection technique employed with the arrangements of FIGS. 3-5) may be a mixture of both unfragmented precursor ions from some of the chambers and the fragments of precursor ions from other chambers.

In that case, the process can be repeated for multiple scan cycles, for the same or at least overlapping mass ranges from the ion source, but with different fragmentation schemes applied to the different scan cycles. For example, in cycle 1, with 50 fragmentation cell chambers, chamber numbers 1, 2, 5, 9 and 32 might receive specific precursor ions $m_1$ $m_2$ $m_5$ $m_9$ and $m_{32}$ respectively (under the control of the controller 60 and the rastering device 30) but then store those precursor ions of masses $m_1$ $m_2$ $m_5$ $m_9$ and $m_{32}$ in the respective chambers and subsequently eject them to the mass analyser 50 without fragmentation. The remaining chambers may fragment the ions of masses $m_3$ $m_4$ $m_{6-8}$ $m_{10-31}$ and $m_{33-50}$. In a second cycle of the arrangement, for example, a different subset of chambers can fragment the same or a different set of precursor ions (for example, in scan cycle 2, precursor ions of masses $m_{19}$ and $m_{36}$ might instead be allowed to pass through the fragmentation cell 40 without fragmentation). As well or instead, different fragmentation conditions can be applied in different cycles.

By taking this multicycle approach, and using different fragmentation parameters in each cycle, it is possible to deconvolve and decode mixtures of fragment and precursor ions in the mass analyser, and hence arrive at separate fragment and precursor spectra without the need to obtain these separately. That said, a single cycle is sufficient, particularly where the analyte is of known or suspected identity, and/or by judiciously selecting the chambers and their content precursor masses.

Still further, whilst the invention has been described above, for the sake of simplicity and clarity of explanation, in the context of only a single precursor species having a single mass to charge ratio within each fragmentation cell chamber, the invention is by no means so limited. For example, the controller 60 and the rastering device 30 may together be configured to subdivide the precursor ions from the ion source and having a relatively broad mass range, into a plurality of segments some or all of which contains multiple precursor ions across a relatively narrower mass range forming a subset of the broad mass range (with some containing only a single ion species). Thus it is to be understood that reference to a "mass", or a "mass to charge ratio" is intended to mean both a single ion species having a single mass/mass to charge ratio, and also a mass range containing two or more different ion species and/or two or more different mass to charge ratios (whether or not those different mass to charge ratios are discriminated during analysis, should they have a very similar m/z).

The techniques for parallel processing of such segments containing multiple precursor species—and indeed a more detailed explanation of some exemplary decoding strategies, where multiple cycles with differing fragmentation cell chamber fragmentation schemes are employed, are set out in our above mentioned co-pending application entitled "Method of tandem mass spectrometry", filed at the UKIPO on the same date as the present application.

The invention claimed is:

1. A method of tandem mass spectrometry comprising:

generating ions to be analysed, from an ion source;

separating the generated ions into a sequence of precursor ions separated in time in accordance with their mass to charge ratio;

directing ions of a mass to charge ratio $M_i$ at a time $t_i$ into an $i^{th}$ one of a plurality of N spatially separated fragmentation cell chamber arranged in parallel with one another in a fragmentation cell;

fragmenting ions in the $i^{th}$ chamber;

directing ions of a mass to charge ratio $M_j$ at a time $t_j$, into a $j^{th}$ one of the plurality of N spatially separated parallel fragmentation cell chambers;

fragmenting ions in the $j^{th}$ chamber;

ejecting fragment ions and any remaining precursor ions from each of the fragmentation cell chambers to a mass analyser; and analysing ions from each chamber in the mass analyser.

2. The method of claim 1, wherein ions of at least two different masses $M_i$, $M_j$ are fragmented and stored in respective ones of the spatially separated fragmentation cell chambers at partially overlapping times.

3. The method of claim 1, wherein the step of ejecting fragment ions and remaining precursor ions comprises:

(a) in a first cycle ejecting ions containing and/or fragmented from precursors of mass $M_N$ from an $N^{th}$ one of the chambers to the mass analyser;

(b) in a subsequent cycle, once the $N^{th}$ chamber is empty transferring ions containing and/or fragmented from precursors of mass $M_{(N-1)}$ from an $(N-1)^{th}$ chamber to the $N^{th}$ chamber;

(c) in a further subsequent cycle ejecting the ions containing and/or fragmented from precursors of mass $M_{(N-1)}$, now in the $N^{th}$ chamber, to the mass analyser.

4. The method of claim 3, where N>2, the step of ejecting fragment ions and remaining precursor ions comprising:

(a) ejecting ions containing and/or fragmented from precursors of mass analysis from the Nth chamber to the mass analyser;

(b) over (N−1) subsequent cycles shifting ions from a $(N-1)^{th}$ chamber to the Nth chamber, then shifting ions from the $(N-2)^{th}$ chamber to the $(N-1)^{th}$ chamber, and so forth until the first chamber contents have been shifted into the second chamber; and (c) repeating steps (a) and (b) so as to empty the contents of each of the N Chambers out to the mass analyser via the Nth chamber.

5. The method of claim 3, further comprising:

trapping ions ejected from the $N^{th}$ chamber in an RF storage device, and ejecting them orthogonally towards the mass analyser.

6. The method of claim 1, wherein the step of ejecting fragment ions and remaining precursor ions to the mass analyser comprises:

ejecting ions from each of the N fragmentation cell chambers in a direction that is not towards any other cell chamber such that the ions from each chamber arrive at the mass analyser without first passing through any of the other chambers.

7. The method of claim 6, further comprising decelerating precursor ions using an Einzel lens.

8. The method of claim 1, further comprising employing an ion deflector to direct ions of the mass $M_i$ into the $i^{th}$ one of the fragmentation cell chambers and to direct ions of the mass $M_j$ into the $j^{th}$ one of the fragmentation cell chambers.

9. The method of claim 8, further comprising applying a pulsed voltage to the ion deflector to direct the ions to respective fragmentation cell chambers.

10. The method of claim 9, further comprising adjusting the energy of the precursor ions prior to entry into the fragmentation cell chambers.

11. The method of claim 1, further comprising differentially pumping a channel between the ion deflector and the fragmentation cell.

12. The method of claim 1, further comprising fragmenting the precursor ions using one or more of the following:

collisional fragmentation, activated ion electron transfer dissociation (ETD); multistage ETD, electron capture dissociation (ECD), electron ionisation dissociation (EID), ion-ion, ion-molecule, ion-photon reactions, and/or metastable-atom dissociation.

13. An arrangement for a tandem mass spectrometer; comprising:

a fragmentation cell containing a plurality of N spatially separate fragmentation cell chambers arranged in parallel with one another, each fragmentation cell chamber having a respective ion entrance for selectively receiving incoming ions from upstream of the fragmentation cell; the fragmentation cell further comprising at least one ion exit for ejecting the incoming ions and/or their fragments from the fragmentation cell; the arrangement also having:

a controller configured to control the parameters of the N chambers such that in use, ions entering an $i^{th}$ one of the N chambers experience different fragmentation conditions to ions entering a $j^{th}$ one of the cells ($i \neq j$; $i \leq N$, $j \leq N$).

14. The arrangement of claim 13 wherein the fragmentation cell further comprises a plurality N, of ion entrance apertures, each in communication with the ion entrance of a respective fragmentation cell chamber.

15. The arrangement of claim 14, wherein each ion entrance aperture of the fragmentation cell includes an entrance deflector for directing incident ions to a respective fragmentation cell chamber.

16. The arrangement of claim 13, wherein each chamber comprises an RF only multipole.

17. The arrangement of claim 16, wherein the fragmentation cell further comprises a gas input port for supplying collision gas to the chambers.

18. The arrangement of claim 13, wherein the fragmentation cell further comprises a linear trap arranged (a) to receive ions from an $i^{th}$ one of the fragmentation cell chambers, (b) to store ions along a curved longitudinal axis of the curved linear trap, and (c) to eject ions orthogonally to that curved longitudinal axis towards a mass analyser.

19. The arrangement of claim 18, wherein each of the N chambers comprises an ion output aperture, and wherein an $i^{th}$ chamber ion output aperture communicates with the ion entrance of an $(i+1)^{th}$ chamber, save that the ion output aperture of the $N^{th}$ chamber communicates with the input of the linear trap.

20. The arrangement of claim 13, wherein each of the N chambers comprises an ion output aperture in communication with an output aperture of the fragmentation cell.

21. The arrangement of claim 20, wherein the fragmentation cell comprises a plurality, N, of output apertures, each being in communication with a respective one of the N output apertures of each fragmentation cell chamber.

22. The arrangement of claim 20, further comprising an Einzel lens within each chamber entrance.

23. A tandem mass spectrometer comprising:

an ion source for generating ions to be analysed;

a first mass analyser configured to separate the ions generated by the ion source into a sequence of precursor ions, each separated in accordance with their mass to charge ratio $M_i$ (i=1 . . . R) such that they emerge from the first stage of mass analysis at different times $T_i$;

a fragmentation cell containing a plurality of N spatially separate fragmentation cell chambers arranged in parallel with one another each fragmentation cell chamber having a respective ion entrance for selectively receiving incoming ions from upstream of the fragmentation cell; the fragmentation cell further comprising at least one ion exit for ejecting the incoming ions and/or their fragments from the fragmentation cell, the arrangement also having a controller configured to control the parameters of the N chambers such that in use ions entering an $i^{th}$ one of the N chambers experience different fragmentation conditions to ions entering a $j^{th}$ one of the cells ($i \neq j$; $i \leq N$, $j \leq N$);

an ion deflector under the control of the controller and positioned between the first mass analyser and the fragmentation cell, the ion deflector configured to deflect ions of an $i^{th}$ mass $M_i$ arriving at a time $t_i$ at the ion deflector from the first mass analyser towards the fragmentation cell for capture and fragmentation by an $i^{th}$ fragmentation cell chamber and to deflect ions of a $j^{th}$ mass $M_j$ (j=1 . . . R; $j \neq i$) arriving at a time $t_j$ at the ion deflector from the first mass analyser at a time $t_j$ towards the fragmentation cell for capture and fragmentation by a $j^{th}$ fragmentation cell chamber; and a second mass analyser located downstream of the fragmentation cell and adapted to analyse ions ejected from the at least one ion exit of the fragmentation cell.

24. The tandem mass spectrometer of claim 23 wherein the ion source is a pulsed, continuous or quasi continuous ion source.

25. The tandem mass spectrometer of claim 23, wherein the first mass analyser is one of:

(a) an ion trap;

(b) a time of flight (TOF) mass analyser;

(c) an ion mobility spectrometer; or (d) a spatially dispersing analyser such as distance of flight or magnetic sector analyser.

26. The tandem mass spectrometer of claim 25, wherein the first mass analyser is one of a linear ion trap with radial or axial ejection; a multi-turn or multi-reflection TOF; or a magnetic sector analyser.

27. The tandem mass spectrometer of claim 23, wherein the second mass analyser comprises one of an orbital trapping analyser or a time of flight analyser.

28. The tandem mass spectrometer of claim 23, wherein the ion deflector comprises first and second deflector plates, and further wherein the controller is arranged to cause pulsed voltages to be applied to those deflector plates.

29. The tandem mass spectrometer of claim 28, further comprising an energy lifter arranged to adjust the energy of ions so that they enter the fragmentation cell chamber to which the ions are directed at an optimum energy for the required degree of fragmentation of those ions.

30. The tandem mass spectrometer of claim 29, wherein the controller is configured to cause the deflector plates and the energy lifter to be pulsed with a voltage in synchronism.

31. The tandem mass spectrometer of claim 23, further comprising a pumping means for differentially pumping a volume between the ion deflector and the fragmentation cell.

* * * * *